US011855329B2

(12) United States Patent
Liu et al.

(10) Patent No.: US 11,855,329 B2
(45) Date of Patent: Dec. 26, 2023

(54) FILTERING ANTENNA FOR WEARABLE APPARATUS

(71) Applicant: South China University of Technology, Guangdong (CN)

(72) Inventors: Xiongying Liu, Guangzhou (CN); Haixiang Zhu, Guangzhou (CN); Zhongxin Li, Guangzhou (CN); Hongcai Yang, Guangzhou (CN)

(73) Assignee: South China University of Technology, Guangdong (CN)

( * ) Notice: Subject to any disclaimer, the term of this patent is extended or adjusted under 35 U.S.C. 154(b) by 614 days.

(21) Appl. No.: 17/056,013

(22) PCT Filed: Oct. 18, 2018

(86) PCT No.: PCT/CN2018/110817
§ 371 (c)(1),
(2) Date: May 25, 2021

(87) PCT Pub. No.: WO2019/218590
PCT Pub. Date: Nov. 21, 2019

(65) Prior Publication Data

US 2021/0273319 A1 Sep. 2, 2021

(30) Foreign Application Priority Data

May 17, 2018 (CN) ..... 201810473582.3

(51) Int. Cl.
*H01Q 1/27* (2006.01)
*H01Q 1/38* (2006.01)
(Continued)

(52) U.S. Cl.
CPC ..... *H01Q 1/273* (2013.01); *H01Q 1/38* (2013.01); *H01Q 1/52* (2013.01); *H01Q 9/0407* (2013.01); *H01Q 15/0006* (2013.01)

(58) Field of Classification Search
CPC ..... H01Q 1/273; H01Q 1/38; H01Q 1/52; H01Q 9/0407; H01Q 15/0006
See application file for complete search history.

(56) References Cited

U.S. PATENT DOCUMENTS

2015/0035715 A1 2/2015 Kim et al.

FOREIGN PATENT DOCUMENTS

CN 204067576 12/2014
CN 104269615 1/2015
(Continued)

*Primary Examiner* — Graham P Smith
(74) *Attorney, Agent, or Firm* — JMB Davis Ben-David

(57) ABSTRACT

The invention discloses a filtering antenna for wearable devices, which includes a top dielectric substrate, a bottom dielectric substrate, an antenna radiation unit, a top metal ground, a bottom metal ground, and an artificial magnetic conductor structure. The antenna radiation unit is printed on an upper surface of the top dielectric substrate, the top metal ground is printed on a lower surface of the top dielectric substrate, the artificial magnetic conductor structure is etched on an upper surface of the bottom dielectric substrate, and the bottom metal ground is printed on a lower surface of the bottom dielectric substrate. The antenna radiation unit is formed by a circular patch and a microstrip coupling feed stub structure. The invention has the advantages of miniaturization, easy integration, low profile, high gain, anti-interference, may work in the 5.8-GHz ISM frequency band, may be used in wearable devices, has filtering effect etc., and is suitable in the field of human body wireless local area network communications.

8 Claims, 6 Drawing Sheets

(51) Int. Cl.

| | |
|---|---|
| ***H01Q 1/52*** | (2006.01) |
| ***H01Q 9/04*** | (2006.01) |
| ***H01Q 15/00*** | (2006.01) |

(56) References Cited

FOREIGN PATENT DOCUMENTS

| | | |
|---|---|---|
| CN | 105789875 | 7/2016 |
| CN | 107834212 | 3/2018 |
| CN | 108493589 | 9/2018 |

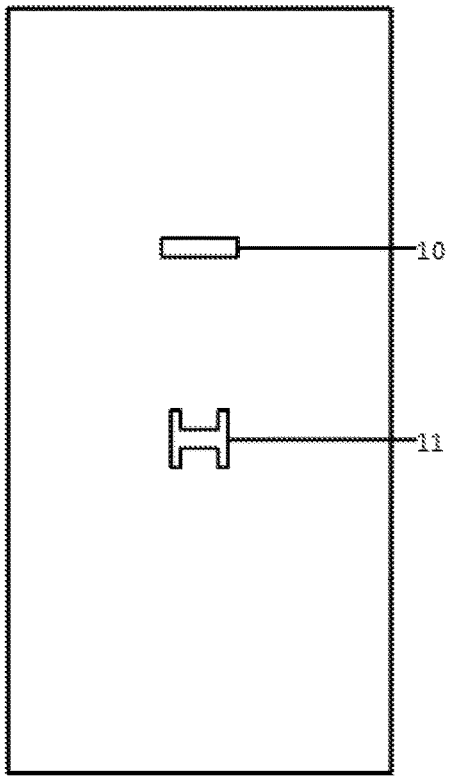
Fig. 2（a）
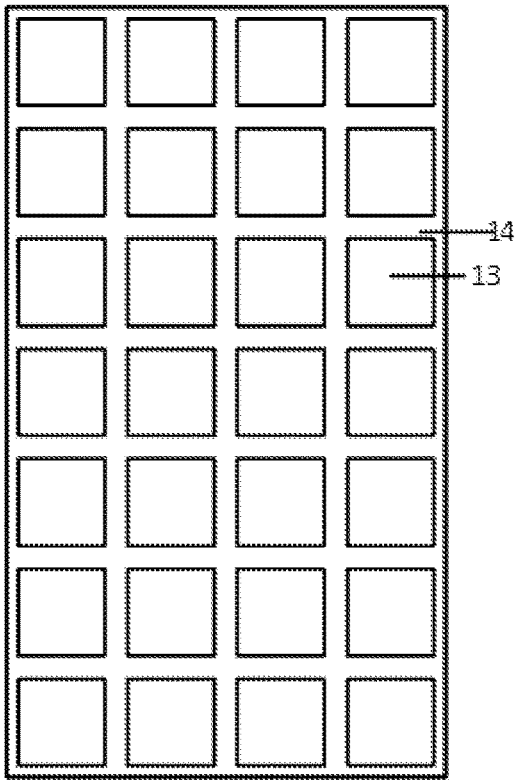
Fig. 2（b）

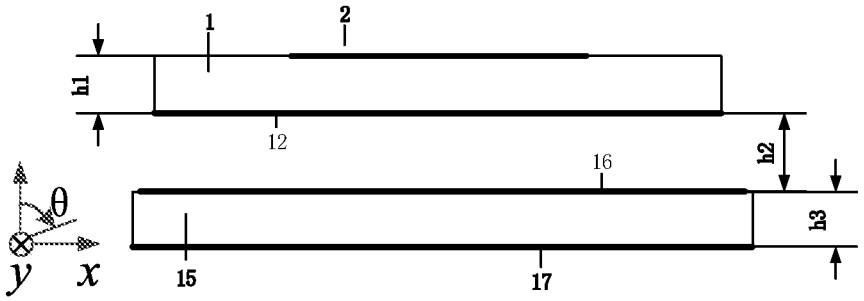
Fig. 2（c）
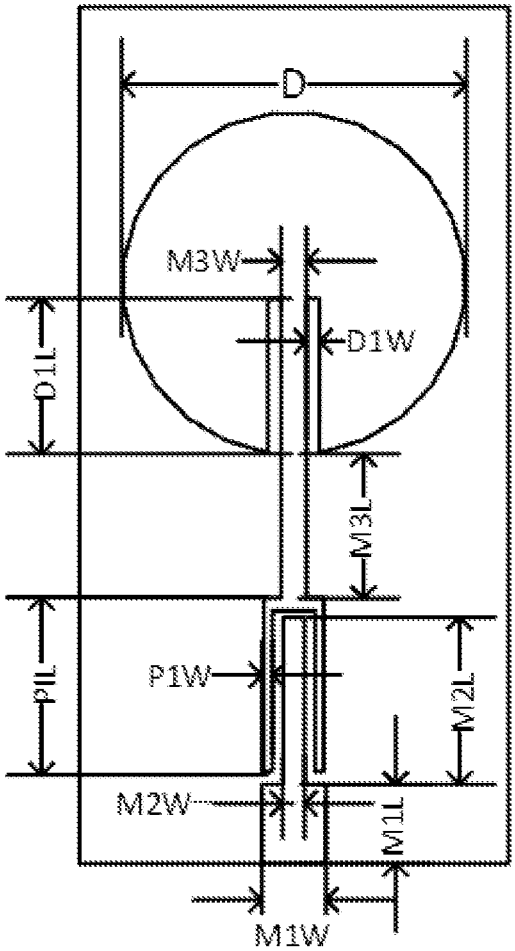
Fig. 3（a）

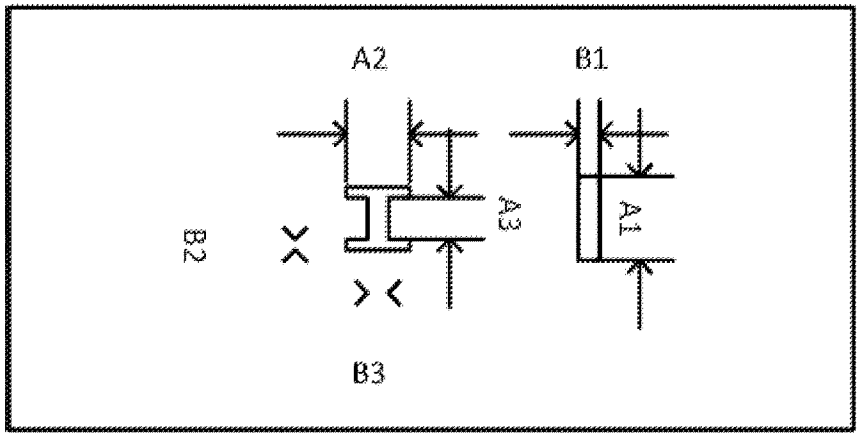
Fig. 3（b）
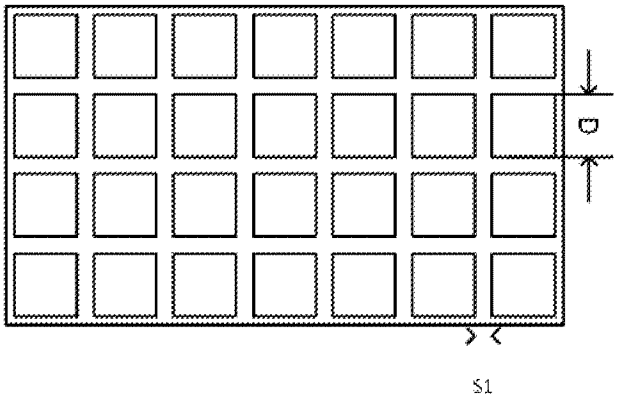
Fig. 3（c）

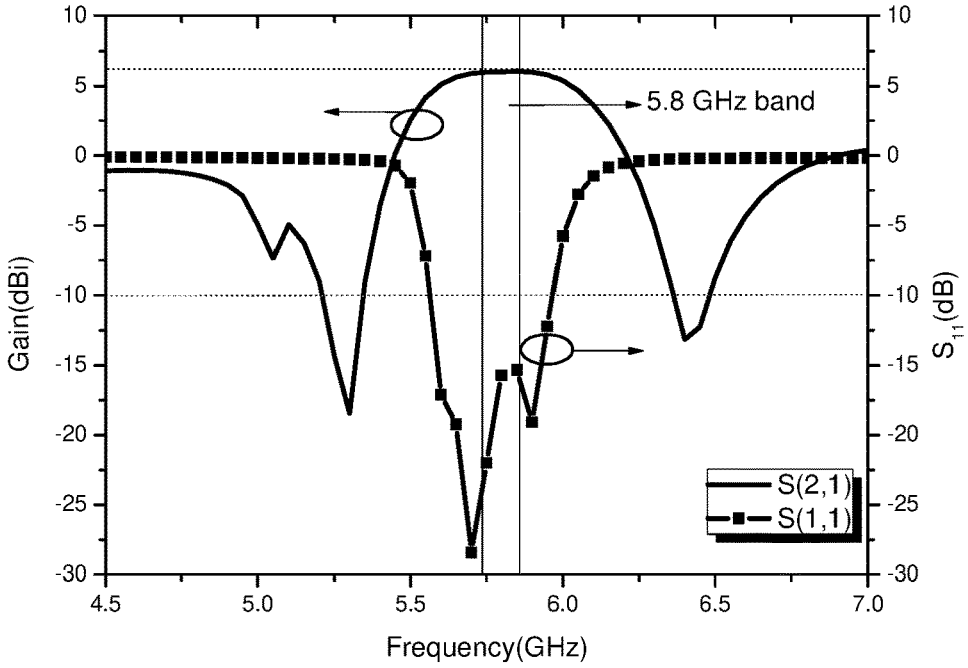
Fig. 4
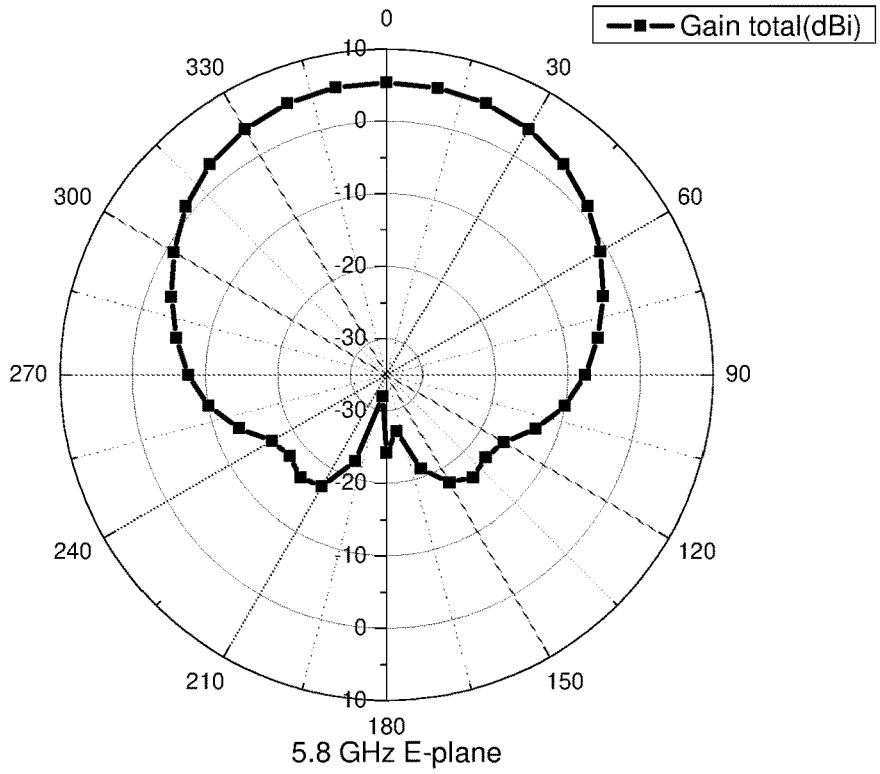
Fig. 5（a）

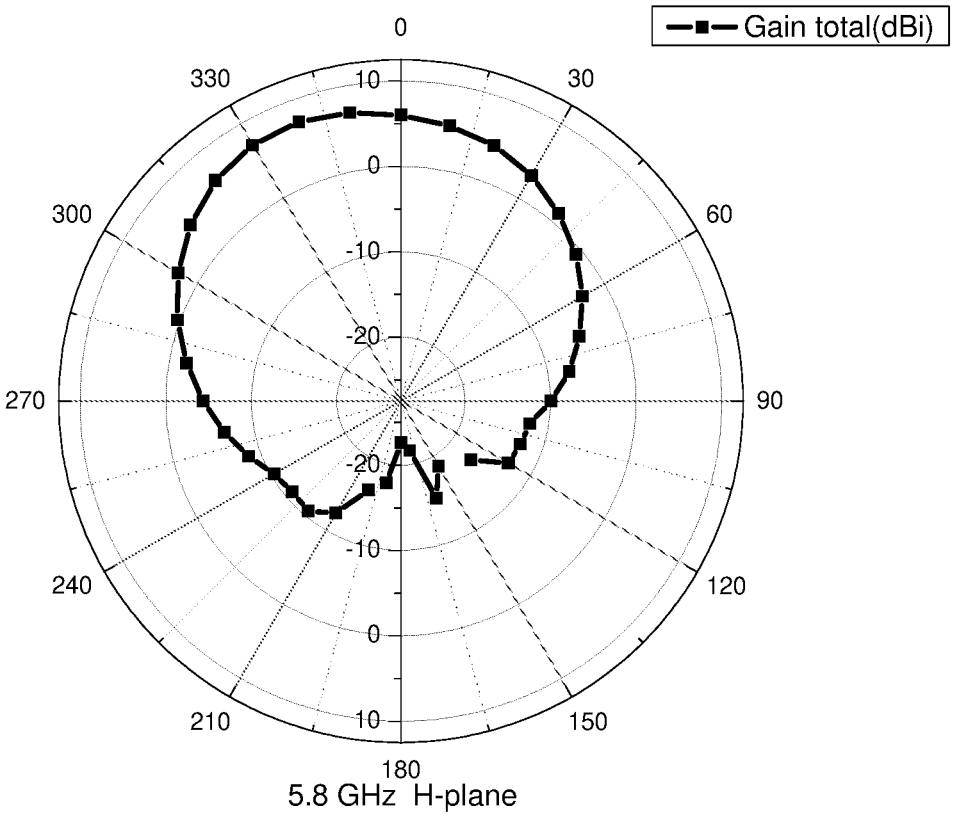
Fig. 5（b）

FILTERING ANTENNA FOR WEARABLE APPARATUS

TECHNICAL FIELD

The proposed invention relates to the field of wearable devices, in particular to a filtering antenna for wearable devices.

TECHNICAL BACKGROUND

As an important part of the fourth-generation wireless communication systems, human-centered communication can be applied in some specific situations, such as telemedicine, fire rescue, military battlefields, personal entertainment. Wearable antennas take critical role in the research of human-centered communication systems. Wearable antennas can be worn on the human body and can be integrated into smart devices on clothing or worn on a certain part of the human body, developed on the basis of conventional antennas. Different structures, materials and processes are introduced in the production process.

Since the wearable antenna works in proximity of the human body, and the human body is formed by a variety of tissues with different shapes, different electromagnetic characteristics, and inhomogeneous dispersion, which have a great impact on the performance of the antenna, the design concept of a wearable antenna is different from that of a general antenna. On the other hand, most of the currently designed wearable antenna technologies have no filtering function. Instead, a filter and an antenna are connected through a coaxial line to achieve filtering characteristics, which exhibits high loss, large volume, low integration and other shortcomings, which are not conducive to the development of the miniaturization of wearable devices.

Therefore, under the current trend of increasingly high degree of circuit integration, it is particularly important to design a device that can be worn on the human body and integrates the two functions of filtering and antenna, that is, a wearable filtering antenna.

SUMMARY OF THE INVENTION

In order to address the drawbacks and deficiencies in the prior art, the proposed invention provides a filtering antenna for wearable devices. The filtering antenna of the invention works in the ISM frequency band (5.725-5.875 GHz) with small size, easy integration, low profile, high gain, and applicable to wearable devices.

The technical solutions adopted by the present invention:

A filtering antenna for wearable devices, comprising a top dielectric substrate, a bottom dielectric substrate, an antenna radiating unit, a top metal ground, a bottom metal ground, and an artificial magnetic conductor structure, the antenna radiation unit is printed on an upper surface of the top dielectric substrate, the top metal ground is printed on a lower surface of the top dielectric substrate, the artificial magnetic conductor structure is etched on an upper surface of the bottom dielectric substrate, and the bottom metal ground is printed on a lower surface of the bottom dielectric substrate;

the antenna radiation unit is formed by a circular patch and a microstrip coupling feed stub structure.

Two slots are formed in the circular patch, and the two slots extend from a circumference to a circle center and are parallel to each other;

the microstrip coupling feed stub structure is composed of a first rectangular microstrip line, an inverted U-shaped microstrip line, and an edge-feeding network, the first rectangular microstrip line is connected to the circular patch and the inverted U-shaped microstrip respectively, the inverted U-shaped microstrip line is embedded with an inverted U-shaped gap, a second rectangular microstrip line is provided in the inverted U-shaped gap, the second rectangular microstrip line is connected to the edge-feeding network.

The top metal ground is provided with a rectangular slot and an H-shaped slot; the rectangular slot and the H-shaped slot are symmetrical about a longitudinal axis of the top dielectric substrate.

The artificial magnetic conductor structure is formed by a 7×4 rectangular patch array, and a distance between adjacent rectangular patches is 1 mm.

The two slots, the first rectangular microstrip line, the second rectangular microstrip line, the inverted U-shaped microstrip line and the edge-feeding network are all symmetrical about a longitudinal axis of the top dielectric substrate.

The slots are rectangular slots.

A distance between the top dielectric substrate and the bottom dielectric substrate is 1.2 mm.

A width of the inverted U-shaped slot is 0.4 mm.

The beneficial effects of the present invention:

(1) The present invention provides a filtering antenna with small size, easy integration, low profile, high gain, and applicable to wearable devices;

(2) The symmetrical rectangular slots on the surface of the circular patch may generate a transmission null at a certain frequency point, so that a notch is generated on the curve of gain at the corresponding frequency point. The transmission null position can be adjusted by changing the length of the rectangular slots. Correspondingly at the upper frequencies, a second transmission null is generated through the coupling of the feed network and the radiating patch. Changing the coupling length may adjust the position of the transmission null. The two transmission nulls are generated at the upper and lower frequencies respectively, thereby achieving a filtering effect;

(3) The artificial magnetic conductor structure is adopted to reduce the overall thickness of the antenna, alleviate the radiation effect of the antenna on the human body, improve the gain and front-to-back ratio of the antenna, and at the same time weaken the impact of the complex electromagnetic characteristics of the human body on the antenna performance. The coupling feed structure may effectively increase the bandwidth of the microstrip antenna.

DESCRIPTION OF THE FIGURES

FIG. 2 (*a*) is a structural diagram of the top metal ground;

FIG. 2 (*b*) is a structural diagram of the artificial magnetic conductor;

FIG. 2(*c*) is an illustrative diagram of an arrangement of the top dielectric substrate and the bottom dielectric substrate;

FIG. 3 (*a*), FIG. 3 (*b*) and FIG. 3 (*c*) are annotated illustrative diagrams of the antenna radiating unit, the top metal ground and the artificial magnetic conductor structure respectively;

FIG. 4 is a simulation diagram of the return loss coefficient and gain of a filtering antenna used in a wearable device according to the present invention in a simulation of a three-layer human tissue model;

FIGS. 5(*a*) and 5(*b*) are gain diagrams of the present invention on the XOY and the YOZ planes, respectively.

DESCRIPTION

Figure 1:
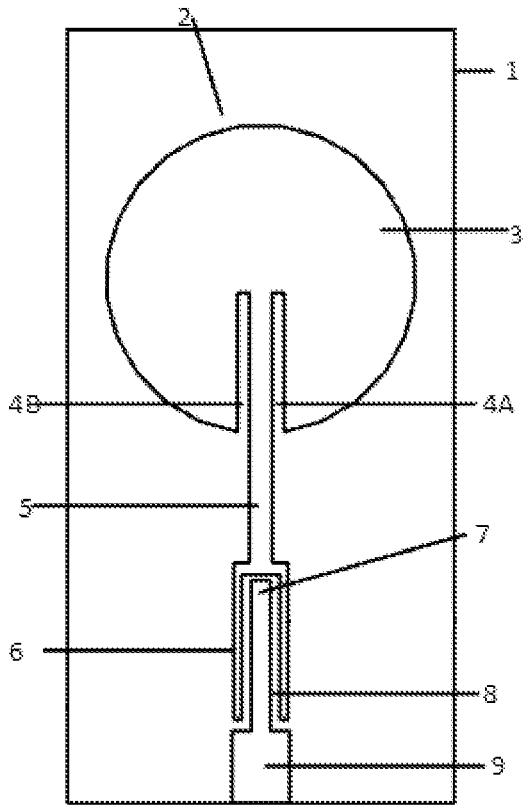
FIG. 1 is an illustrative diagram of a structure of the antenna radiating unit of the present invention.

In the following, the present invention will be further described in detail with reference to the embodiments and figures, but the implementation of the present invention is not limited thereto.

Embodiments

As shown in FIG. 1, FIG. 2(*a*), FIG. 2(*b*) and FIG. 2(*c*), a filtering antenna for wearable devices comprises a top dielectric substrate 1, a bottom dielectric substrate 15, an antenna radiation unit 2, a top metal ground 12, the bottom metal ground 17 and an artificial magnetic conductor structure. the antenna radiation unit is printed on an upper surface of the top dielectric substrate, the top metal ground is printed on a lower surface of the top dielectric substrate, the artificial magnetic conductor structure is etched on an upper surface of the bottom dielectric substrate, and the bottom metal ground is printed on a lower surface of the bottom dielectric substrate.

The antenna radiating unit is formed by a circular patch 3 and a microstrip coupling feed stub structure. The circular patch has two slots 4A, 4B, and the two slots are located in a lower part of the circular patch, extending from the circumference to the circle center. The two slots are parallel and symmetrical about a longitudinal center line of the top dielectric substrate. The slots are rectangular. The diameter of the circular patch in this embodiment is 15.6 mm. The length of the slots is equal, specifically as 7.8 mm and the width is 0.8 mm.

The symmetrical rectangular slots part is equivalent to an LC resonant circuit, and a transmission null is generated at the edge of the passband.

The microstrip coupling feed stub structure is formed by a first rectangular microstrip line 5, an inverted U-shaped microstrip line 6, a second rectangular microstrip line 7 and an edge-feeding network 9. The first rectangular microstrip line is connected to the circular patch and the inverted U-shaped microstrip respectively. An upper end of the first rectangular microstrip line is connected with two slots, and a lower end is connected with a transverse part of the inverted U-shaped microstrip line.

The inverted U-shaped microstrip line is embedded with an inverted U-shaped gap 8. A second rectangular microstrip line 7 is provided in the inverted U-shaped gap. The second rectangular microstrip line is connected to the edge-feeding network 9.

In this embodiment, the width of the first rectangular microstrip line is 1.4 mm and the length is 7.4 mm. The inverted U-shaped microstrip line is formed by one horizontal microstrip line and two symmetrical vertical microstrip lines. The width of the vertical microstrip lines is 0.4 mm and the length is 7.7 mm.

The width of the inverted U-shaped slit is 0.4 mm. The width of the second rectangular microstrip line is 1 mm and the length is 8 mm.

The two slots, the first rectangular microstrip line, the second rectangular microstrip line, the inverted U-shaped gap, the inverted U-shaped microstrip line, the second rectangular microstrip line and the edge-feeding network are all symmetrical about a longitudinal axis of the top dielectric substrate.

The microstrip coupling is equivalent to an LC resonant circuit in a circuit, and a transmission null is generated at the edge of the passband to achieve filtering effect.

The top metal ground is provided with a rectangular slot 10 and an H-shaped slot 11. The H-shaped slot is provided below a horizontal axis of the top dielectric substrate, and the distance to the bottom edge of the ground is 15.4 mm. The rectangular slot is located above the horizontal axis, and the distance to the bottom edge of the ground is 26.6 mm, all symmetrical about a longitudinal axis. The top dielectric substrate and the bottom dielectric substrate are arranged at a certain distance. The upper surface of the bottom dielectric substrate is etched with artificial magnetic conductor structure 16, which is the AMC structure, which is specifically formed by a rectangular patch array. In this embodiment, it is formed by 7×4 rectangular patch array structure. The distance between adjacent rectangular patches is 1 mm. The side length of each square patch is 4.5 mm, and the thickness is 0.813 mm.

A group of an inverted U-shaped microstrip line, an inverted U-shaped slot and an edge-feeding network in the microstrip coupling feeding stub for coupling feed are introduced in the configuration of the proposed antenna.

In this embodiment, the top dielectric substrate 1 and the bottom dielectric substrate 15 both use Rogers RO4003. Its relative permittivity is 3.55, and the electrical loss tangent is 0.0027. The length of the top dielectric substrate 1 is 40 mm, the width is 20 mm, and the thickness is 0.813 mm. The overall outlines of the antenna radiation unit and the metal ground patch are both a rectangle. The AMC structure is formed by periodic square patches 13. The spacing 14 of each square patch is 1 mm. The side length of each square patch is 4.5 mm, and the thickness is 0.813 mm. The periodic square patch is formed by 7×4 units. The height between the top dielectric substrate 1 and the bottom dielectric substrate 15 is 1.2 mm.

As shown in FIG. 3(*a*), FIG. 3(*b*) and FIG. 3(*c*), the specific parameters are the diameter of the circular patch D=5.6 mm. The length of the symmetrical slots of the circular patch is: D1L=7.8 mm, the width is: D1W=0.8 mm. The length of the inverted U-shaped microstrip line is: P1L=7.7 mm, the width is: P1W=0.4 mm. The gap distance between the inverted U-shaped microstrip stub and the embedded microstrip line is 0.4 mm. The first rectangular microstrip line connected to the circular patch: M3L=7.4 mm, the width is: M3W=1.4 mm. The length of the embedded second rectangular microstrip line is: M2L=8 mm, the width is: M2W=1 mm. The length of the edge-feeding network is: M1L=3.3 mm, the width is: M1W=3 mm. The length of the rectangular slot of the bottom metal ground is: A1=4 mm, the width is: B1=1 mm. The length of the middle horizontal bar of the H-shaped slot is: A3=2 mm, the width is: B3=1 mm. The vertical length of the bar on both sides is: A2=3 mm, the width is: B2=0.5 mm.

The side length of the square patch of the artificial magnetic conductor structure is: D=4.5 mm, and the distance between two adjacent square patches is: S1=2 mm.

As shown in FIG. 4, FIG. 5(*a*) and FIG. 5(*b*), the present invention is placed on a three-layer human tissue model of skin, fat and muscle for simulation. The present invention is close to the human skin during simulation. The invention adopts microstrip coupling feeding, and the coupling feeding structure is a symmetrical structure. A LC resonant equivalent circuit is generated through the structure of the coupling feeding and the radiating patch with a rectangular slot, thereby generating two transmission nulls, and realizing filtering effect. Through inverted U-shaped microstrip stub and embedded microstrip line, the coupling area is increased. By loading an AMC structure under the antenna, the gain and front-to-back ratio of the antenna are improved, and the impact of the human body on the performance of the antenna is reduced. The invention achieves a filtering effect, works in a single frequency band (5.6-5.95 GHz), that is, works in the Industrial, Scientific, and Medical frequency bands (ISM frequency band: 5.725-5.875 GHz). The gain in the passband is about 6 dBi, and may be used for data transmission of wearable devices and other functions.

The antenna has the advantages of miniaturization, easy integration, low profile, high gain, anti-interference, may work in the ISM frequency band, may be used in wearable devices, and has filtering effect etc.

The above-mentioned embodiments are preferred embodiments of the present invention, but the embodiments of the present invention are not limited by the embodiments, and any other changes, modifications, substitutions, simplifications and combinations made without departing from the spirit and principle of the present invention should all be equivalent replacement methods, and they are all included in the protection scope of the present invention.

The invention claimed is:

1. A filtering antenna for wearable devices, characterized in that, comprising a top dielectric substrate, a bottom dielectric substrate, an antenna radiating unit, a top metal ground, a bottom metal ground, and an artificial magnetic conductor structure, the antenna radiation unit is printed on an upper surface of the top dielectric substrate, the top metal ground is printed on a lower surface of the top dielectric substrate, the artificial magnetic conductor structure is etched on an upper surface of the bottom dielectric substrate, and the bottom metal ground is printed on a lower surface of the bottom dielectric substrate;

the antenna radiation unit is formed by a circular patch and a microstrip coupling feed stub structure.

2. The filtering antenna according to claim 1, characterized in that, two slots are formed in the circular patch, and the two slots extend from a circumference to a circle center and are parallel to each other;

the microstrip coupling feed stub structure is formed by a first rectangular microstrip line, an inverted U-shaped microstrip line, and an edge-feeding network, the first rectangular microstrip line is connected to the circular patch and the inverted U-shaped microstrip respectively, the inverted U-shaped microstrip line is embedded with an inverted U-shaped gap, a second rectangular microstrip line is provided in the inverted U-shaped gap, the second rectangular microstrip line is connected to the edge-feeding network.

3. The filtering antenna according to claim 1, characterized in that, the top metal ground is provided with a rectangular slot and an H-shaped slot; the rectangular slot and the H-shaped slot are symmetrical about a longitudinal axis of the top dielectric substrate.

4. The filtering antenna according to claim 1, characterized in that, the artificial magnetic conductor structure is formed by a 7×4 rectangular patch array, and a distance between adjacent rectangular patches is 1 mm.

5. The filtering antenna of claim 2, characterized in that, the two slots, the first rectangular microstrip line, the second rectangular microstrip line, the inverted U-shaped microstrip line and the edge-feeding network are all symmetrical about a longitudinal axis of the top dielectric substrate.

6. The filtering antenna of claim 2, characterized in that, the slots are rectangular slots.

7. The filtering antenna according to claim 1, characterized in that, a distance between the top dielectric substrate and the bottom dielectric substrate is 1.2 mm.

8. The filtering antenna of claim 2, characterized in that, a width of the inverted U-shaped slot is 0.4 mm.

* * * * *